US009082573B2

(12) United States Patent
Zhu et al.

(10) Patent No.: US 9,082,573 B2
(45) Date of Patent: Jul. 14, 2015

(54) VACUUM ARC EXTINGUISHING CHANGE-OVER SELECTOR

(71) Applicants: Qiang Zhu, Shanghai (CN); Yiming Yu, Shanghai (CN); Chengbao Wang, Shanghai (CN)

(72) Inventors: Qiang Zhu, Shanghai (CN); Yiming Yu, Shanghai (CN); Chengbao Wang, Shanghai (CN)

(73) Assignee: SHANGHAI HUAMING POWER EQUIPMENT CO. LTD, Shanghai (CN)

( * ) Notice: Subject to any disclaimer, the term of this patent is extended or adjusted under 35 U.S.C. 154(b) by 132 days.

(21) Appl. No.: 13/793,720

(22) Filed: Mar. 11, 2013

(65) Prior Publication Data

US 2013/0306601 A1 Nov. 21, 2013

(30) Foreign Application Priority Data

May 17, 2012 (CN) ..... 2012 1 0155015

(51) Int. Cl.
*H01H 33/666* (2006.01)
*H01H 9/00* (2006.01)

(52) U.S. Cl.
CPC ..... *H01H 33/6661* (2013.01); *H01H 9/0016* (2013.01); *H01H 9/0038* (2013.01)

(58) Field of Classification Search
CPC ..... H01H 9/0038; H01H 2009/0061; H01H 9/0005
USPC ..... 218/118
See application file for complete search history.

(56) References Cited

U.S. PATENT DOCUMENTS

| | | | | |
|---|---|---|---|---|
| 3,819,892 | A * | 6/1974 | Rathbun | 218/118 |
| 3,925,722 | A * | 12/1975 | Fohrhaltz et al. | 324/415 |
| 4,081,741 | A * | 3/1978 | Palmer | 323/340 |
| 2012/0139510 | A1 * | 6/2012 | Wrede | 323/258 |

* cited by examiner

*Primary Examiner* — Truc Nguyen
(74) *Attorney, Agent, or Firm* — John P. White; Cooper & Dunham LLP

(57) ABSTRACT

Disclosed is a change-over selector with a vacuum arc extinguishing circuit, including a central shaft, a moving contact driven by the central shaft to rotate, and a first static contact and a second static contact circularly arranged on insulation laths of a cage body of the change-over selector, where the moving contact is driven by the central shaft to rotate to switch between the first static contact and the second static contact, the moving contact and the first and second static contacts form a change-over selection main-circuit, a vacuum arc extinguishing sub-circuit including a vacuum tube is connected in parallel to the change-over selection main-circuit, the vacuum tube is opened after the moving contact is separated from the first static contact, and the vacuum tube is closed before the moving contact is electrically connected to the second static contact.

8 Claims, 6 Drawing Sheets

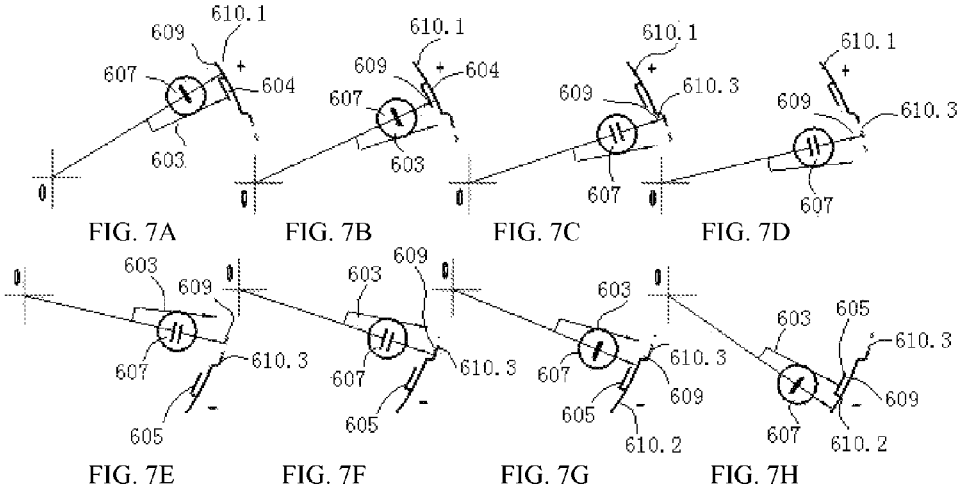
FIG. 7A FIG. 7B FIG. 7C FIG. 7D
FIG. 7E FIG. 7F FIG. 7G FIG. 7H
FIG. 7
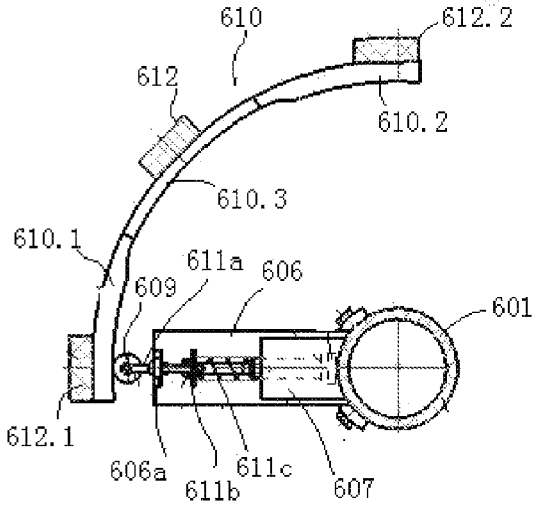
FIG. 8

VACUUM ARC EXTINGUISHING CHANGE-OVER SELECTOR

BACKGROUND

1. Technical Field

The present invention relates to the field of on-load tap-changer technologies, and particularly to a change-over selector with a vacuum arc extinguishing circuit.

2. Related Art

For an on-load tap-changer, in the case that a transformer is on load, that is, is uninterrupted, a turn ratio of a primary winding to a secondary winding of the transformer is changed by changing winding taps connected to the transformer, so as to achieve the purpose of changing an output voltage of the transformer.

The existing combinational on-load tap-changer is divided into two parts, that is, a change-over switch and a selector. For some transformers, a voltage regulating range is required to be large, and the number of stages is large. A change-over selector can be added in the selector part. A polarity of a voltage regulating winding of the transformer is changed over or connection of a coarse or thin regulation winding is changed, so as to achieve the purpose of expanding the voltage regulating range of the transformer without increasing the taps of the voltage regulating winding of the transformer.

The change-over selector changes over the polarity of the voltage regulating winding of the transformer or changes the connection of the coarse or thin regulation winding, that is, a coarse or thin regulation change-over selector and a polarity change-over selector. The operation can only be performed at a middle position of the whole voltage regulating range, that is, moving contacts of the coarse or thin regulation change-over selector and the polarity change-over selector perform coarse or thin regulation and polarity change-over regulation at a K position.

The operation of the polarity change-over selector shown in FIG. 1A, FIG. 1B, and FIG. 1C is performed on a tapped "middle position", that is, the tap selector is located in a K position. When the polarity is changed over, at the moment that the moving contact leaves "+" or "−", the voltage regulating winding of the transformer is separated from the primary winding, and the voltage regulating winding is in an electrical "floating" state.

The operation of the coarse regulation change-over selector shown in FIG. 2A, FIG. 2B, and FIG. 2C is performed on a tapped "middle position", that is, the tap selector is located in a "K" position. During change-over, at the moment that the moving contact leaves "+" or "−", the voltage regulating winding of the transformer is separated from the primary winding, and the voltage regulating winding is in an electrical "floating" state.

Since a voltage exists on an winding adjacent to the voltage regulating winding and coupling capacitance exists between the voltage regulating winding and the adjacent winding and between the voltage regulating winding and an adjacent grounding body, at the moment of separation, a new potential different form a potential of the voltage regulating winding before the actions of the coarse regulation change-over selector and the polarity change-over selector occurs on the voltage regulating winding, and the moving contacts of the coarse regulation change-over selector and the polarity change-over selector are still on the original potential. The potential difference between two potentials is called a displacement voltage (or called an offset voltage). The voltage acts on a clearance between the moving contact of the coarse regulation change-over selector or the polarity change-over selector and a "+" or "−" static contact at the same time, so the voltage is called a recovery voltage. When a value of the recovery voltage exceeds the endurance of the change-over selector, continuous discharging may occur on the clearance of the change-over selector.

The intensity of the capacitance current and recovery voltage depends on a system voltage, a coil arrangement manner, and capacitance and a ratio between coils. For a given coil arrangement manner and coil capacitance, the capacitance current cannot be reduced.

In order to limit the recovery voltage, the prior art generally adopts the following solutions:

1. A fixed potential resistor $R_P$ is mounted between a middle portion of a voltage regulating coil and a change-over switch leading-out terminal (referring to FIG. 3). In this method, the structure is simple, but the potential resistor $R_P$ is conductive for a long term, which wastes power, plays a role of increasing the temperature of the transformer oil, and is not beneficial for running of the transformer.

2. Referring to FIG. 4A, FIG. 4B and FIG. 4C, a potential resistor R is concatenated to a potential switch M linked to a moving contact. The potential switch M is connected to the potential resistor R only during the change-over operation. The purpose of using the potential switch M is to avoid many potential resistors, thereby simplifying the mounting of the potential resistor and reducing the reactive compensation. In this method, the structure of the change-over selector is complex.

3. Change-over selection without interruption is implemented by using a dual polarity change-over principle as shown in FIG. 5A, FIG. 5B, and FIG. 5C. The basic principle is as follows. In the change-over selector, a pair of static contacts 1, 1*a* and a pair of moving contacts 2, 2*a* are used to implement change-over selection. In the change-over process, the moving contact 2 is gradually switched from contact with the static contact 1 to contact with the static contact 1*a*, and the moving contact 2*a* is gradually switched from contact with the static contact 1*a* to contact with the static contact 1, that is, in the change-over process of the moving contacts 2, 2*a*, the electrical "floating" does not occur. Therefore, the recovery voltage problem does not exist, that is to say, spark discharge does not occur. However, in the dual polarity change-over selector designed by using the principle, a drive mechanism needs to be additionally configured, synchronization with the on-load tap-changer needs to be taken into consideration, and the mechanical structure is complex; moreover, the contact group of the no-load tap-changer is arranged in a panel, a mounting position needs to be left on the transformer, and a control system and an operating system need to be provided, thereby increasing the cost of the device, and increasing the volume and the oil consumption of the transformer.

SUMMARY

The technical problem to be solved by the present invention is to provide a change-over selector with a vacuum arc extinguishing circuit for extinguishing an arc by using a vacuum arc extinguishing chamber (also called a vacuum tube), so as to overcome the disadvantage in the prior art.

The technical problem to be solved by the present invention can be solved through the following technical solution.

A change-over selector with a vacuum arc extinguishing circuit includes a central shaft, a moving contact driven by the central shaft to rotate, and a first static contact and a second static contact circularly arranged on insulation laths of a cage body of the change-over selector, where the moving contact is driven by the central shaft to rotate to switch between the first static contact and the second static contact, the moving contact and the first and second static contacts form a change-over selection main-circuit, a vacuum arc extinguishing sub-circuit including a vacuum tube is connected in parallel to the change-over selection main-circuit, the vacuum tube is opened after the moving contact is separated from the first static contact, and the vacuum tube is closed before the moving contact is electrically connected to the second static contact.

The vacuum arc extinguishing circuit is driven by the central shaft to rotate in synchronization with the moving contact The vacuum arc extinguishing sub-circuit further includes a vacuum tube drive mechanism, a support component for mounting the vacuum tube and the vacuum tube drive mechanism, a cam mounted on the insulation laths of the cage body of the change-over selector, the support component is made of an insulation material and is mounted on the central shaft, the vacuum tube drive mechanism is made of a conductive material and, together with the vacuum tube, is mounted on the support component, the vacuum drive mechanism has a force-bearing end in contact with the cam and a drive end in contact with a moving contact end of the vacuum tube, the cam is divided into three segments, a middle segment is an insulation segment, two ends are a first conductive segment and a second conductive segment respectively, the first conductive segment is electrically connected to the first static contact, and the second conductive segment is electrically connected to the second static contact.

In a preferred embodiment of the present invention, the vacuum tube drive mechanism includes a lever base fixed on the support component, a force-bearing bar disposed on the lever base in a slidable manner, a drive bar, and a lever hinged to the lever base, a roller in contact with the cam is mounted at an outer end of the force-bearing bar, an inner end of the force-bearing bar is hinged to one end of the lever, an outer end of the drive bar is hinged to the other end of the lever, and an inner end of the drive bar is in contact with the moving contact end of the vacuum tube.

In another preferred embodiment of the present invention, the vacuum tube drive mechanism includes a force-bearing bar disposed on the support component in a slidable manner, a spring base is disposed on a middle portion of the force-bearing bar, a roller in contact with the cam is mounted at an outer end of the force-bearing bar, an inner end of the force-bearing bar is sleeved with a spring and then is connected to the moving contact end of the vacuum tube, an outer end of the spring is in contact with the spring base, and an inner end of the spring is in contact with an end surface of a tube body of the vacuum tube.

The principle of the present invention is that, in the case of a normal load current, the load current is borne by electrical connections of the moving contact and the static contact. When the change-over selector acts, the moving contact first leaves one static contact. In this case, since the roller is in electrical contact with the conductive segment electrically connected to the static contact, the vacuum arc extinguishing sub-circuit formed by the vacuum tube is turned on, no potential difference exists between the moving contact and the static contact, no arc is generated when the moving contact is separated from the static contact, and the vacuum arc extinguishing sub-circuit formed by the vacuum tube bears the load current. Under the control of the cam, the contacts in the vacuum tube are opened. A recovery voltage is generated between the separated contacts in the vacuum tube, thereby generating an arc. The vacuum arc extinguishing sub-circuit formed by the vacuum tube enters the middle segment of the control cam. The moving contact continuously transits to the other static contact. Before the moving contact is in contact with the other static contact, the roller enters the other conductive segment electrically connected to the other static contact, and the contacts in the vacuum tube are closed. In the closing process, a recovery voltage is generated in the vacuum tube, thereby generating an arc. Then, the moving contact is connected to the other static contact. In this case, since the vacuum arc extinguishing sub-circuit formed by the vacuum tube is already electrically connected to the static contact, no potential difference exists between the moving contact and the static contact, and no current is generated during contact.

It can be seen from the foregoing change-over process that, in the present invention, the arc only occurs in the vacuum tube, and no arc occurs outside the tube, so transformer oil where the switch is located is not contaminated.

Since the present invention adopts the foregoing technical solution, compared with the prior art, the present invention has the following significant advantages:

1. The mechanism is simplified and is reliably controlled, and the problem of transformer oil contamination by the arc generated by the change-over selector is solved thoroughly.

2. The structure is small, so that the space occupied by the change-over selector can be reduced, thereby saving the space of the transformer box, and reducing the cost of the transformer and the transformer oil.

BRIEF DESCRIPTION OF THE DRAWINGS

FIG. 7A, FIG. 7B, FIG. 7C, FIG. 7D, FIG. 7E, FIG. 7F, FIG. 7G and FIG. 7H are schematic principle diagrams of a change-over process of the change-over selector with a vacuum arc extinguishing circuit of Embodiment 1 of the present invention.

FIG. 8 is a schematic structural diagram of a vacuum arc extinguishing sub-circuit of a change-over selector with a vacuum arc extinguishing circuit of Embodiment 2 of the present invention.

DETAILED DESCRIPTION

The following embodiments further describe the present invention, but the embodiments are only intended to illustrate the present invention rather than limit the present invention.

Figure 1A:
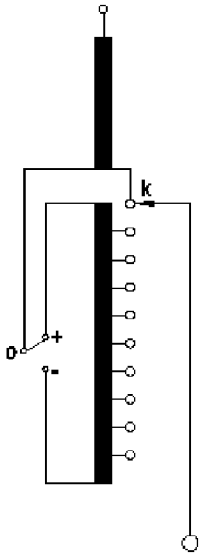
FIG. 1A, FIG. 1B, and FIG. 1C are schematic circuit diagrams of a linear polarity regulating change-over selector.
Figure 1B:
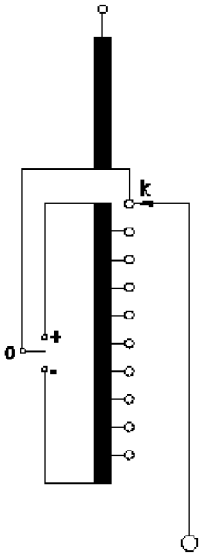
Figure 1C:
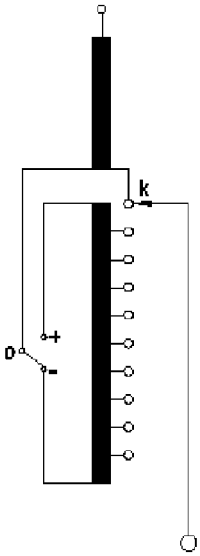
Figure 2A:
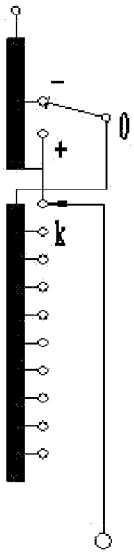
FIG. 2A, FIG. 2B, and FIG. 2C are schematic circuit diagrams of a coarse or thin regulation change-over selector.
Figure 2B:
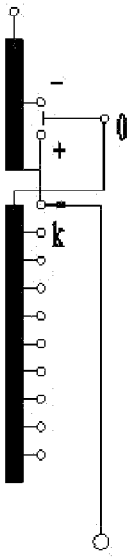
Figure 2C:
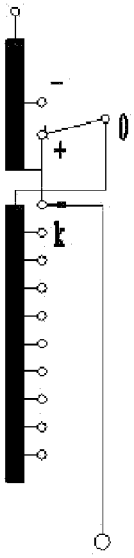
Figure 3:
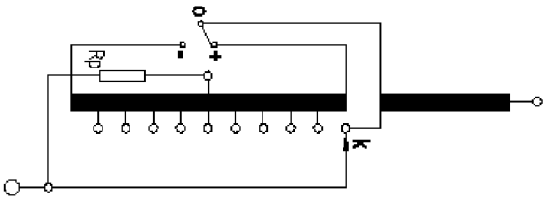
FIG. 3 is a schematic circuit diagram of a change-over selector with a fixed potential resistor.
Figure 4A:
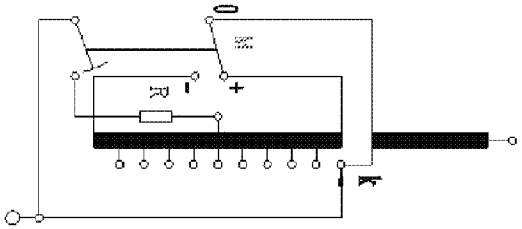
FIG. 4A, FIG. 4B, and FIG. 4C are schematic circuit diagrams of a change-over selector, where a potential resistor is concatenated to a switch linked to a moving contact.
Figure 4B:
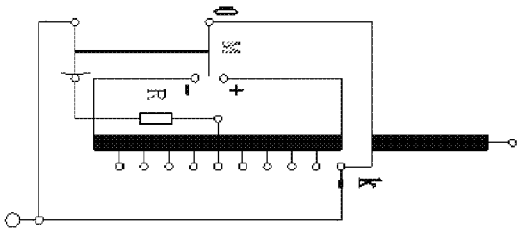
Figure 4C:
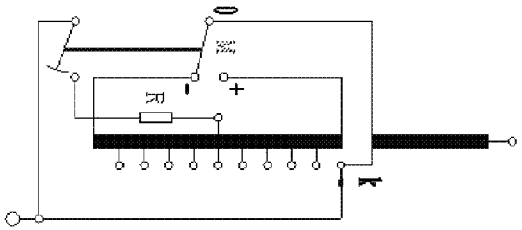
Figure 5A:
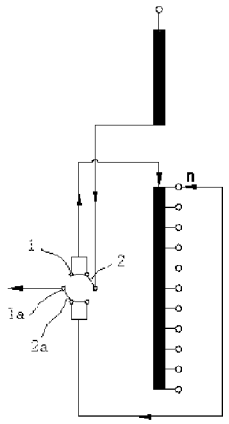
FIG. 5A, FIG. 5B, and FIG. 5C are schematic diagrams of a dual polarity change-over selector.
Figure 5B:
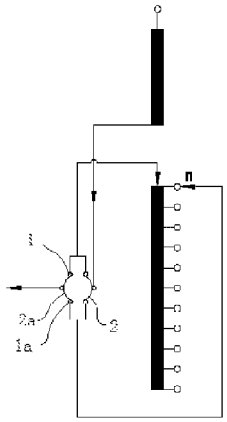
Figure 5C:
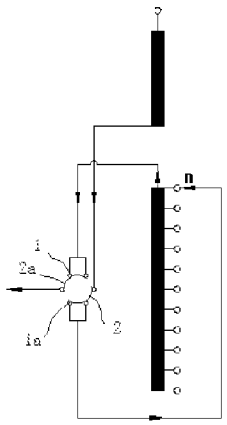
Figure 6:
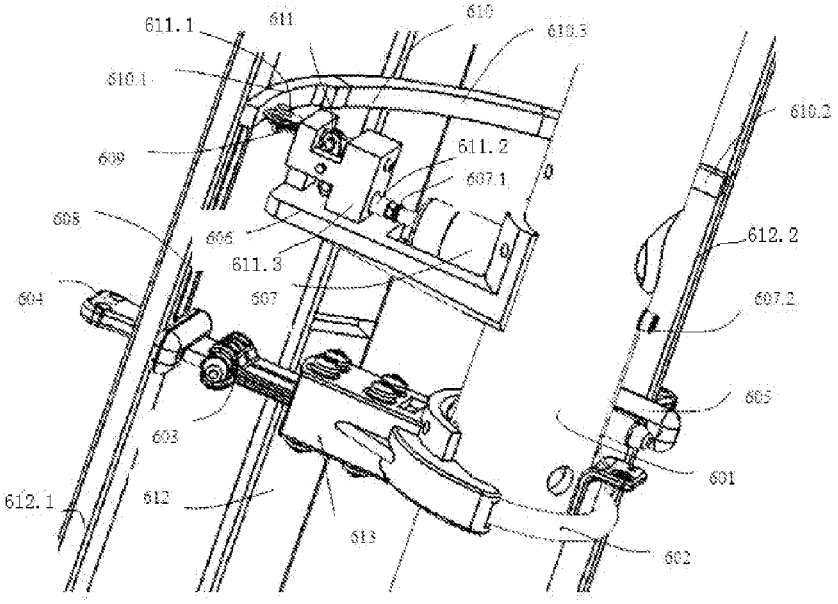
FIG. 6 is a schematic structural diagram of a change-over selector with a vacuum arc extinguishing circuit of Embodiment 1 of the present invention.

Referring to FIG. 6, a change-over selector with a vacuum arc extinguishing circuit includes a central shaft 601. A clip-type moving contact 603 is mounted on a moving contact stand 613 by using a spring in a floating manner. The moving contact stand 613 is fixed on the central shaft 601 of the change-over selector. In this way, the central shaft 601 can drive the moving contact stand 613 and the moving contact 603 to rotationally swing back and forth. An inner end of the moving contact 603 is clamped on a leading-out ring 302 to form an electrical connection. The leading-out ring 302 is fixed on the central shaft 601.

Static contacts 604 and 605 are mounted on circularly distributed insulation laths 612.1 and 612.2 taking the central shaft 601 as a circle center and fixed on a cage body of the change-over selector in a circular distribution manner. Between the insulation laths 612.1 and 612.2 is an insulation lath 612. In this way, an outer end of the moving contact 603 can form an electrical connection with the static contact 604 or the static contact 605 respectively with rotational swing of the central shaft 601. The moving contact 603 and the static contacts 604 and 605 form a change-over selection main-circuit.

The characteristic of the present invention is that, a vacuum arc extinguishing sub-circuit including a vacuum tube is connected in parallel to the change-over selection main-circuit formed by the moving contact 603 and the static contacts 604 and 605. The specific structure is as follows. The vacuum arc extinguishing sub-circuit including a vacuum tube is mounted above or below a moving contact assembly formed by the moving contact 603 and the moving contact stand 613 in an axial direction of the central shaft 601.

The vacuum arc extinguishing sub-circuit including a vacuum tube is formed by components such as a support component 606 made of an insulation material, a vacuum tube 607, a roller 609, a lever 611, a force-bearing bar 611.1, a drive bar 611.2, a lever base 611.3, and a cam 610. The vacuum tube 607, the roller 609, the lever 611, the force-bearing bar 611.1, the drive bar 611.2, and the lever base 611.3 are all made of a conductive material.

The support component 606 is substantially an L-shaped part. A straight segment of the support component 606 is fixed on the central shaft 601. The lever base 611.3 and the vacuum tube 607 are mounted on a transverse segment of the support component 606 in front and back positions. The force-bearing bar 611.1 and the drive bar 611.2 are disposed on the lever base 611.3 in a slidable manner. The lever 611 is hinged to the lever base 611.3. The roller 609 is mounted at an outer end of the force-bearing bar 611.1, and an electrical connection is formed between the roller 609 and the outer end of the force-bearing bar 611.1. An inner end of the force-bearing bar 611.1 is hinged to an upper end of the lever 611, and an electrical connection is formed between the inner end of the force-bearing bar 611.1 and the upper end of the lever 611. An outer end of the drive bar 611.2 is hinged to a lower end of the lever 611, and an electrical connection is formed between the outer end of the drive bar 611.2 and the lower end of the lever 611. An inner end of the drive bar 611.2 is in contact with a moving contact end of the vacuum tube 607, and an electrical connection is formed between the inner end of the drive bar 611.2 and the moving contact end of the vacuum tube 607. An electrical connection is formed between a static contact end 607.2 of the vacuum tube 607 and the leading-out ring 602.

The cam 610 is fixed on circularly distributed insulation laths 612.1, 612 and 612.2 of the cage body of the change-over selector. The cam 610 is divided into three segments. The middle segment is an insulation segment 610.3, and two ends are metal conductive segments 610.1 and 610.2 respectively. An electrical connection is formed between the conductive segment 610.1 and the static contact 604 by laying a connection sheet 608 on an inner edge of the insulation lath 612.1. An electrical connection is formed between the conductive segment 610.2 and the static contact 605 by laying a connection sheet (not shown) on an inner edge of the insulation lath 612.1.

A detailed change-over process of the change-over selector with a vacuum arc extinguishing circuit of this embodiment is as follows.

Referring to FIG. 7A, in the case of a normal load current, although the roller 609 is in contact with the conductive segment 610.1 of the cam, the load current is borne by electrical connections of the moving contact 603 and the static contact 604.

Referring to FIG. 7B, when the change-over selector acts, the moving contact 603 first leaves the static contact 604. In this case, since the roller 609 is in electrical contact with the conductive segment 610.1 electrically connected to the static contact 604, the vacuum arc extinguishing sub-circuit formed by the vacuum tube 607 is turned on, no potential difference exists between the moving contact 603 and the static contact 604, no arc is generated when the moving contact 603 is separated from the static contact 604, and the vacuum arc extinguishing sub-circuit formed by the vacuum tube 607 bears the load current.

Referring to FIG. 7C, when the roller 609 is separated from the conductive segment 610.1 electrically connected to the static contact 604 and enters the insulation segment 610.3 in the middle of the cam, the roller 609 acts on the moving contact end of the vacuum tube 607 through the force-bearing bar, the lever, and the drive bar, contacts of the vacuum tube 607 are opened, and a recovery voltage is generated between the separated contacts in the vacuum tube 607, thereby generating an arc.

Referring to FIG. 7D, FIG. 7E, and FIG. 7F, under the driving of the central shaft, the roller 609 continuously rolls along the insulation segment 610.3 in the middle of the cam to transit to the conductive segment 610.2 at the other end of the cam, and meanwhile, the moving contact 603 also continuously transits to the static contact 605.

Referring to FIG. 7G, before the moving contact 603 is in contact with the other static contact 605, the roller 609 enters the other conductive segment 610.2 electrically connected to the static contact 605, the roller 609 acts on the moving contact end of the vacuum tube 607 through the force-bearing bar, the lever, and the drive bar, contacts in the vacuum tube 607 are closed. In the closing process, a recovery voltage is generated in the vacuum tube 607, thereby generating an arc.

Referring to FIG. 7H, the moving contact 603 is electrically connected to the other static contact 605. In this case, since the vacuum arc extinguishing sub-circuit formed by the vacuum tube 607 is already connected to the static contact 605, no potential difference exists between the moving contact 603 and the static contact 605, and no current is generated during contact.

The change-over selection process may be divided into the following stages.

1. The moving contact 603 is separated from the static contact 604, the vacuum arc extinguishing sub-circuit formed by the vacuum tube 607 is still electrically connected, no coupling potential difference exists when the moving contact 603 is separated from the static contact 604, and no arc is generated.

2. The roller 609 enters a raised position of the conductive portion 610.1 of the cam, the moving and static contacts in the vacuum tube 607 are separated through the action of the lever, and an arc is generated between the moving and static contacts in the vacuum tube 607 due to the action of the coupling potential difference, but the arc is generated in the vacuum tube 607.

3. The roller 609 enters the insulation segment 610.3 in the middle of the cam.

4. The roller 609 enters the conductive portion 610.2 at the other end of the cam, so that the moving and static contacts in the vacuum tube 607 are closed, and an arc is generated between the moving and static contacts in the vacuum tube 607 due to the action of the coupling potential difference, but the arc is generated in the vacuum tube 607.

5. The moving contact 603 is combined with the static contact 605, the vacuum arc extinguishing sub-circuit formed by the vacuum tube 607 is already electrically connected, no coupling potential difference exists when the moving contact 603 is combined with the static contact 605, and no arc is generated, so the selection change-over is completed.

Embodiment 2

A structure of a change-over selector with a vacuum arc extinguishing circuit of this embodiment is basically the same as that in Embodiment 1, where the only difference lies in the drive mechanism of the vacuum tube 607. Referring to FIG. 8, a drive mechanism of a vacuum tube 607 of this embodiment is formed by a force-bearing bar 611*a*, a spring base 611*b*, and a spring 611*c*. A force-bearing bar stand 606*a* made of an insulation material is fixed at a most outer end of a support component 606. The force-bearing bar 611*a* is made of a conductive material and is disposed on the force-bearing bar stand 606*a* in a slidable manner. The spring base 611*b* is made of an insulation material and is fixed at a middle position of the force-bearing bar 611*a*. A roller 609 in contact with a cam 610 is mounted at an outer end of the force-bearing bar 611*a*, and an electrical connection is formed between the roller 609 and the outer end of the force-bearing bar 611*a*. An inner end of the force-bearing bar 611*a* is sleeved with the spring 611*c*, and then is in electrical contact with a moving contact end of the vacuum tube 607, and an electrical connection is formed between the inner end of the force-bearing bar 611*a* and the moving contact end of the vacuum tube 607. An outer end of the spring 611*c* is in contact with the spring base 611*b*, and an inner end of the spring 611*c* is in contact with an end surface of a tube body of the vacuum tube 607.

The cam 610 is fixed on circularly distributed insulation laths 612.1, 612 and 612.2 of the cage body of the change-over selector. The cam 610 is divided into three segments. The middle segment is an insulation segment 610.3, and two ends are metal conductive segments 610.1 and 610.2 respectively. An electrical connection is formed between the conductive segment 610.1 and the static contact 604 by laying a connection sheet (not shown) on an inner edge of the insulation lath 612.1. An electrical connection is formed between the conductive segment 610.2 and the static contact 605 by laying a connection sheet (not shown) on an inner edge of the insulation lath 612.1.

The support component 606 is also fixed on the central shaft 601.

A detailed change-over process of the change-over selector with a vacuum arc extinguishing circuit of this embodiment is as follows.

Referring to FIG. 8, in the case of a normal load current, although the roller 609 is in contact with the conductive segment 610.1 of the cam 610, the load current is borne by electrical connections of the moving contact 603 and the static contact 604 (also referring to FIG. 6). When the change-over selector acts, the moving contact 603 first leaves the static contact 604. In this case, since the roller 609 is in electrical contact with the conductive segment 610.1 electrically connected to the static contact 604, the vacuum arc extinguishing sub-circuit formed by the vacuum tube 607 is turned on, no potential difference exists between the moving contact 603 and the static contact 604, no arc is generated when the moving contact 603 is separated from the static contact 604, and the vacuum arc extinguishing sub-circuit formed by the vacuum tube 607 bears the load current.

Figure 9A:
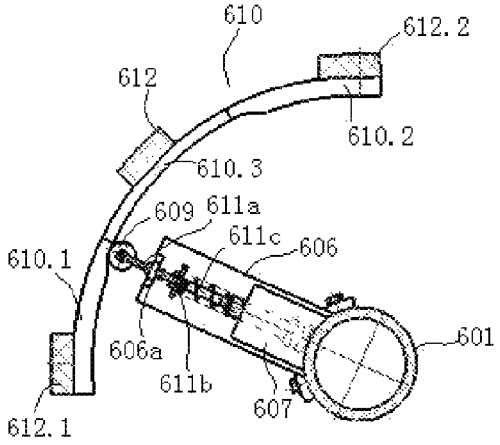
FIG. 9A, FIG. 9B, and FIG. 9C are schematic diagrams of a change-over process of the change-over selector with a vacuum arc extinguishing circuit of Embodiment 2 of the present invention.

Referring to FIG. 9A, when the roller 609 is separated from the conductive segment 610.1 electrically connected to the static contact 604 and enters the insulation segment 610.3 in the middle of the cam 610, the roller 609 acts on the moving contact end of the vacuum tube 607 through the force-bearing bar 611*a*, contacts of the vacuum tube 607 are opened, and a recovery voltage is generated between the separated contacts in the vacuum tube 607, thereby generating an arc. In this case, the spring 611*c* is in a release state.

Figure 9B:
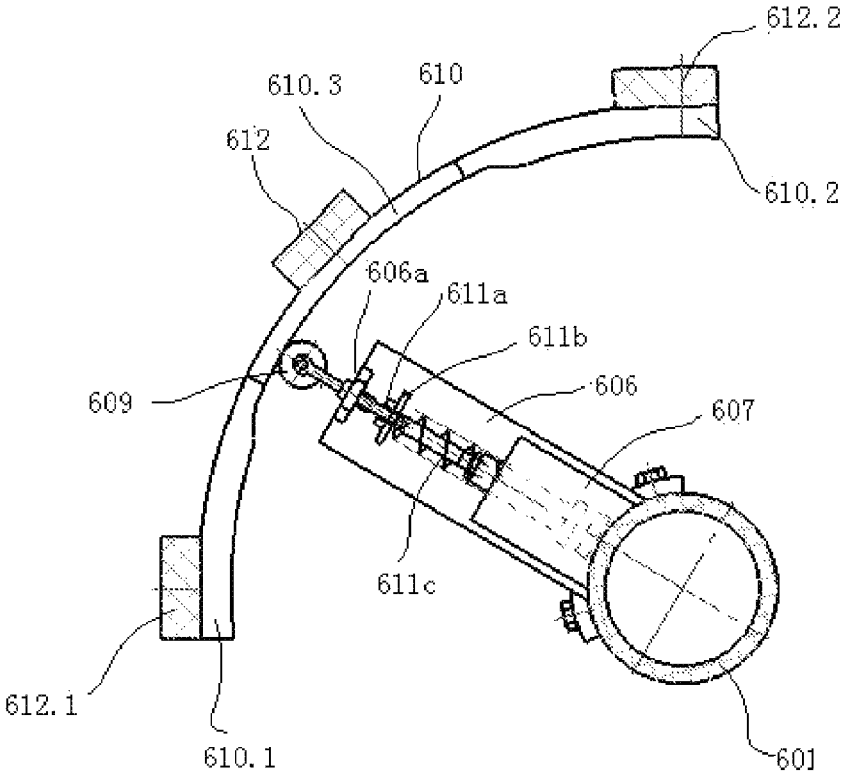

Referring to FIG. 9B, under the driving of the central shaft 601, the roller 609 continuously rolls along the insulation segment 610.3 in the middle of the cam 610 to transit to the conductive segment 610.2 at the other end of the cam 610, and meanwhile, the moving contact 603 also continuously transits to the static contact 605.

Before the moving contact 603 is in contact with the other static contact 605 (referring to FIG. 6), the roller 609 enters the other conductive segment 610.2 electrically connected to the static contact 605, the roller 609 acts on the moving contact end of the vacuum tube 607 through the force-bearing bar 611*a*, contacts in the vacuum tube 607 are closed. In the closing process, a recovery voltage is generated in the vacuum tube 607, thereby generating an arc. In this case, the spring 611*c* is in a compressed state.

Figure 9C:
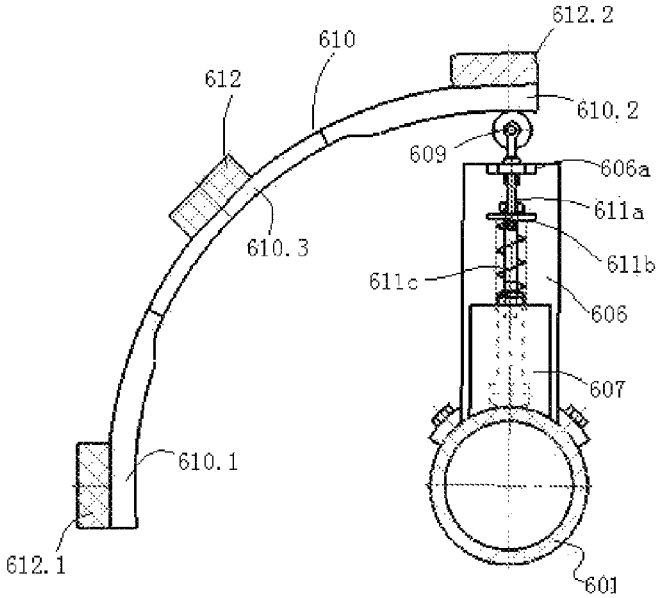

Referring to FIG. 9C, the moving contact 603 is electrically connected to the other static contact 605 (referring to FIG. 6). In this case, since the vacuum arc extinguishing sub-circuit formed by the vacuum tube 607 is already connected to the static contact 605, no potential difference exists between the moving contact 603 and the static contact 605, and no current is generated during contact.

The foregoing content shows and describes the basic principle and main features of the present invention and the advantages of the present invention. Persons skilled in the art should understand that, the present invention is not limited to the embodiments. The embodiments and description of the specification are only intended to describe the principle of the present invention. Various variations and improvements can be made to the present invention without departing from the script and scope of the present invention, and the variations and improvements should all fall within the protection scope claimed in the present invention. The protection scope claimed in the present invention is defined by the appended claims and equivalents thereof.

What is claimed is:

1. A change-over selector with a vacuum arc extinguishing circuit, comprising:

a central shaft;

a first static contact and a second static contact circularly arranged on insulation laths of a cage body of the change-over selector;

a cam circularly arranged on the insulation laths and divided into a first conductive segment, a second conductive segment and an insulation segment which is located between the first conductive segment and the second conductive segment;

a moving contact driven by the central shaft to rotate to switch between the first static contact and the second static contact, the moving contact, the first static contact and the second static contact collectively forming a change-over selection main circuit; and a vacuum arc extinguishing sub-circuit connected to the central shaft and in parallel to the change-over selection main circuit, the vacuum arc extinguishing sub-circuit including a vacuum tube and a roller which is fixed at an end of the vacuum tube and causes the vacuum arc extinguishing sub-circuit to move smoothly along a path on the cam amongst the first conductive segment, the second conductive segment and the insulation segment, wherein the vacuum tube is opened after the moving contact is separated from the first static contact, and the vacuum tube is closed before the moving contact is electrically connected to the second static contact.

2. The change-over selector with a vacuum arc extinguishing circuit according to claim 1, wherein the vacuum arc extinguishing circuit is driven by the central shaft to rotate in synchronization with the moving contact.

3. A change-over selector with a vacuum arc extinguishing circuit, comprising:

a central shaft;

a moving contact driven by the central shaft to rotate; and a first static contact and a second static contact circularly arranged on insulation laths of a cage body of the change-over selector, wherein the moving contact is driven by the central shaft to rotate to switch between the first static contact and the second static contact, the moving contact and the first and second static contacts form a change-over selection main-circuit, a vacuum arc extinguishing sub-circuit comprising a vacuum tube IS connected in parallel to the change-over selection main-circuit, the vacuum tube is opened after the moving contact is separated from the first static contact, and the vacuum tube is closed before the moving contact is electrically connected to the second static contact, and wherein the vacuum arc extinguishing sub-circuit further comprises a vacuum tube drive mechanism, a support component for mounting the vacuum tube and the vacuum tube drive mechanism, a cam mounted on the insulation laths of the cage body of the change-over selector, the support component is made of an insulation material and is mounted on the central shaft, the vacuum tube drive mechanism is made of a conductive material and, together with the vacuum tube, is mounted on the support component, the vacuum tube drive mechanism has a force-bearing end in contact with the cam and a drive end in contact with a moving contact end of the vacuum tube, the cam is divided into three segments, a middle segment is an insulation segment, two ends are a first conductive segment and a second conductive segment respectively, the first conductive segment is electrically connected to the first static contact, and the second conductive segment is electrically connected to the second static contact.

4. The change-over selector with a vacuum arc extinguishing circuit according to claim 3, wherein the vacuum tube drive mechanism comprises a lever base fixed on the support component, a force-bearing bar disposed on the lever base in a slidable manner, a drive bar, and a lever hinged to the lever base, a roller in contact with the cam is mounted at an outer end of the force-bearing bar, an inner end of the force-bearing bar is hinged to one end of the lever, an outer end of the drive bar is hinged to the other end of the lever, and an inner end of the drive bar is in contact with the moving contact end of the vacuum tube.

5. The change-over selector with a vacuum arc extinguishing circuit according to claim 3, wherein the vacuum tube drive mechanism comprises a force-bearing bar disposed on the support component in a slidable manner, a spring base is disposed on a middle portion of the force-bearing bar, a roller in contact with the cam is mounted at an outer end of the force-bearing bar, an inner end of the force-bearing bar is sleeved with a spring and then is connected to the moving contact end of the vacuum tube, an outer end of the spring is in contact with the spring base, and an inner end of the spring is in contact with an end surface of a tube body of the vacuum tube.

6. The change-over selector with a vacuum arc extinguishing circuit according to claim 2, wherein the vacuum arc extinguishing sub-circuit further comprises a vacuum tube drive mechanism, a support component for mounting the vacuum tube and the vacuum tube drive mechanism, a cam mounted on the insulation laths of the cage body of the change-over selector, the support component is made of an insulation material and is mounted on the central shaft, the vacuum tube drive mechanism is made of a conductive material and, together with the vacuum tube, is mounted on the support component, the vacuum tube drive mechanism has a force-bearing end in contact with the cam and a drive end in contact with a moving contact end of the vacuum tube, the cam is divided into three segments, a middle segment is an insulation segment, two ends are a first conductive segment and a second conductive segment respectively, the first conductive segment is electrically connected to the first static contact, and the second conductive segment is electrically connected to the second static contact.

7. The change-over selector with a vacuum arc extinguishing circuit according to claim 6, wherein the vacuum tube drive mechanism comprises a lever base fixed on the support component, a force-bearing bar disposed on the lever base in a slidable manner, a drive bar, and a lever hinged to the lever base, a roller in contact with the cam is mounted at an outer end of the force-bearing bar, an inner end of the force-bearing bar is hinged to one end of the lever, an outer end of the drive bar is hinged to the other end of the lever, and an inner end of the drive bar is in contact with the moving contact end of the vacuum tube.

8. The change-over selector with a vacuum arc extinguishing circuit according to claim 6, wherein the vacuum tube drive mechanism comprises a force-bearing bar disposed on the support component in a slidable manner, a spring base is disposed on a middle portion of the force-bearing bar, a roller in contact with the cam is mounted at an outer end of the force-bearing bar, an inner end of the force-bearing bar is sleeved with a spring and then is connected to the moving contact end of the vacuum tube, an outer end of the spring is in contact with the spring base, and an inner end of the spring is in contact with an end surface of a tube body of the vacuum tube.

* * * * *